United States Patent [19]

Haapanen et al.

[11] Patent Number: 4,721,266

[45] Date of Patent: Jan. 26, 1988

[54] CONTINUOUSLY RUNNING REWINDER WITH PRESSURE ROLLER

[75] Inventors: Pekka Haapanen; Harri Kuosa; Ari Björkman, all of Järvenpää ; Rauno Hagel; Ari Lassila, both of Helsinki, all of Finland

[73] Assignee: Oy Wärtsilä Ab, Helsinki, Finland

[21] Appl. No.: 906,981

[22] Filed: Sep. 15, 1986

[30] Foreign Application Priority Data

Sep. 17, 1985 [FI] Finland ..... 853553

[51] Int. Cl.[4] ..... B65H 19/29; B65H 19/30

[52] U.S. Cl. ..... 242/56 R; 242/58.6; 156/502

[58] Field of Search ..... 242/56 R, 58.1–58.3, 242/58.4–58.6; 156/502, 504

[56] References Cited

U.S. PATENT DOCUMENTS 3,194,508 7/1965 Netze ..... 242/58.2

*Primary Examiner*—Stuart S. Levy
*Assistant Examiner*—Steven M. DuBois
*Attorney, Agent, or Firm*—Birch, Stewart, Kolasch, & Birch

[57] ABSTRACT

The present invention relates to a continuously running rewinder with a pressure roller for winding a paper web, for instance, from a supercalender onto a reel-up drum. The rewinder comprises roll stands, which are provided with a primary drive for rotating a rewinding reel-up drum, a pressure roller assembly including the pressure roller via which the web is routed to pass before entering the rewinding reel-up drum and which can be actuated to swing from an open position to a closed position toward the roll stands so that the pressure roller assembly is pressed against the rewinding reel-up drum to form with it a nip for the web. The rewinder includes a pressing bar, whose path of movement is adapted to pass between the pressure roller and the rewinding reel-up drum and via which the web is routed to pass so that when the bar is in its lower position and the pressure roller assembly in its open position the bar holds the web at a lower level than that of the nip. The rewinder also includes a rail-carriage combination for transferring a completed roll on the reel-up drum off from the roll stands to an exit point, as well as a movable secondary drive, which can be switched over to rotate an almost completed rewinding reel-up drum during the splicing and severing operations of the web. The rewinder in accordance with the present invention facilitates a flying reel-up drum change when using a mandrel rewinder with a pressure roller assembly for rewinding a paper web.

7 Claims, 2 Drawing Figures

CONTINUOUSLY RUNNING REWINDER WITH PRESSURE ROLLER

BACKGROUND OF THE INVENTION

The present invention relates to a continuously running rewinder with a pressure roller. Machines of this type are used for rewinding a web of paper, for instance, from a supercalender onto a reel-up drum.

Continuously running rewinders of the prior art are usually of the so-called pope type. By contrast, a mandrel rewinder of the pressure roller type produces better consistency of the rewound roll than a pope type rewinder. Because continuously running mandrel rewinders have not been available so far, the capacity of conventional mandrel rewinders has been much lower than that of pope type rewinders.

SUMMARY OF THE INVENTION

An object of the present invention is to overcome the aforementioned drawback and to provide flying splicing in a rewinding operation with the pressure roller.

Another object of the present invention is to provide a rewinder system comprising a pressure roller assembly, roll stands, and a reel-up drum transfer device. When the rewinding reel-up drum attains the changeover diameter, the pressure roller assembly is released. Then, a pressure bar pivotable on the pressure roller assembly is swung down. A transfer device moves the reel-up drum, which is rotated by a secondary drive, to the end of transfer rails. A new reel-up drum is transferred by a lift onto the roll stand and its speed is synchronized with the speed of the rewound web. The web is forced on a new reel-up drum, for instance, by a compressed air jet, and the reel-up drum with the completed roll is stopped.

A further object of the present invention is to provide a mandrel rewinder system with a pressure roller that facilitates reel-up drum change without stopping the web feed during a rewind operation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are give by way of illustration only, and thus are not limitative of the present invention, and wherein.

DETAILED DESCRIPTION OF PREFERRED EMBODIMENTS

Figure 1:
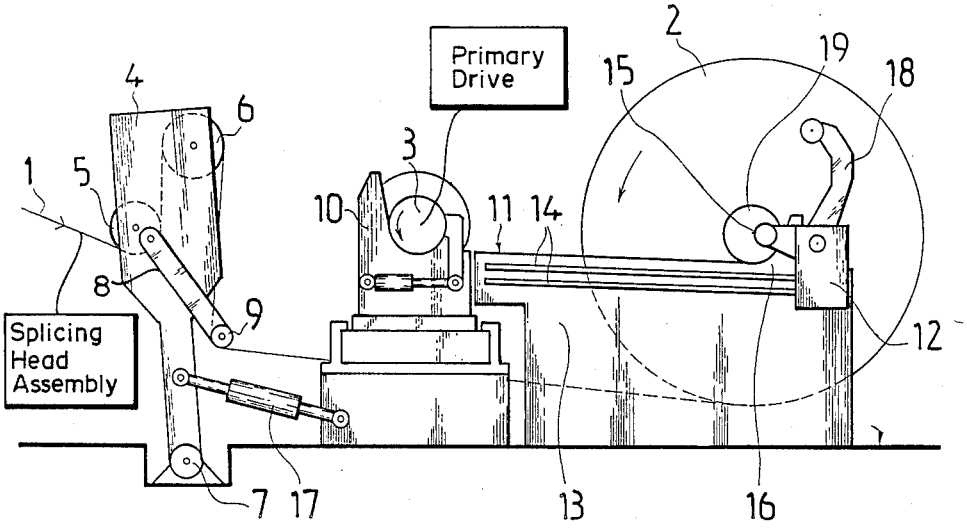
FIG. 1 shows a partially diagrammatic side view of a continuously running rewinder in accordance with the invention before severing the web and splicing with a fresh roll.

The rewinder in accordance with FIG. 1 operates as follows: When a rewinding reel-up drum 2, 3 is supported by roll stands 10, rotated by a primary drive and is attaining the full roll diameter presupposing a changeover, a movable secondary drive 15 mounted on a transfer carriage 12 is connected to the reel-up drum 2. A pressure roller assembly 4 pivotable at a point 7 on a base is released, actuated by a hydraulic cylinder 17, and a bar-shaped pressing shaft 8, 9 pivots and forces web 1 downwardly. A transfer device 11–14 transfers the full reel-up drum 2, which is rotated by the secondary drive 15, off from the roll stands 10 to an exit point 16. Then a lift transfers a new, empty reel-up roll 3 onto the roll stands 10.

The primary drive of the rewinder synchronizes the rotation speed of the new reel-up drum 3 with the web speed. This phase is shown in FIG. 1. The pressing bar 8 rises up and the pressure roller assembly 4 is closed swinging toward the roll stands 10. A knife bar (not shown), located before the pressure roller assembly 4, severs a longitudinal cut at a distance of about 150 mm from the edge of the web 1. A compressed air jet in the roll stand 10 forces this strip over the fresh reel-up drum 3.

Then, the knife bar moves transversely over the entire web 1, forcing the web 1 to be totally engaged on the new reel-up drum 3. The completed roll on the reel-up drum 2 is stopped and it remains waiting for removal.

The construction of the pressure roller assembly 4 is of a standard prior art type, except for a pressing bar 8, 9, pivoted on it and actuated by hydraulic cylinders (not shown). When lifted to the upper position, the shaft part 9 of the pressing bar forms a jaw safety device in front of the nip between the pressure roller 6 and the reel-up roll 3, disposing with a separate jaw safety device. The roll stands 10 are of standard prior art construction incorporating swinging and longitudinal transfer facilities at the service side.

The transfer device of the reel-up drum 2, 3 comprises rolling rails 11, transfer carriages 12, and the secondary drive 15. The reel-up drum 2 is rolled downwards along a gently sloping track, guided by transfer carriages 12. The transfer carriages 12 are mounted to a frame 13 of the rolling rails 11 by ball-bushing guides 14. The carriages 12 are moved by ball-nut lead screws mounted on both rails 11. The ball-nut lead screw movements are synchronized mechanically by a connection shaft and they are rotated by a common drive motor. The secondary drive is a hydraulic motor 15, which is mounted on the transfer carriage 12 of the service side.

Figure 2:
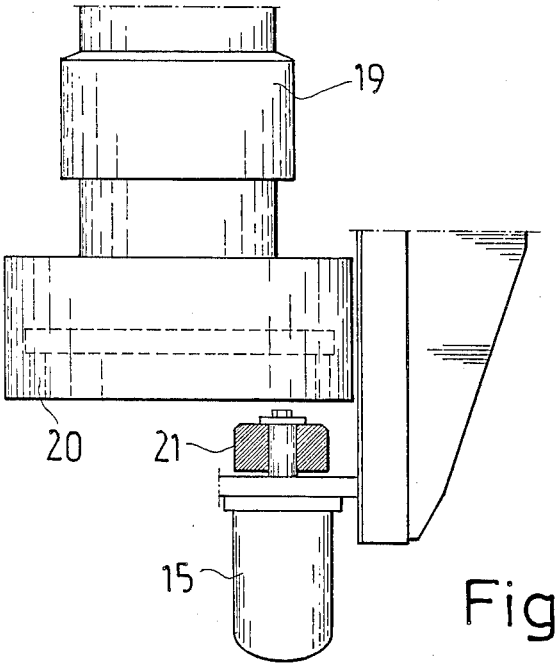
FIG. 2 shows the rewinder of FIG. 1 in a partially phantom top view for the coupling of the rewinder secondary drive to the reel-up drum.

In accordance with FIG. 2, the shaft of the hydraulic motor 15 carries a small gear wheel 21 that drives directly the inner ring 20 of the toothed coupling of a reel-up drum shaft 19, thus forming an inside driven gear with it. This configuration provides a reduction gear, disposing with a separate reduction gear for the hydraulic motor 15.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A continuously running rewinder system comprising:

a reel-up drum on which a paper web can be wound;

roll stands for rotatably supporting said reel-up drum;

primary drive means for rotating said reel-up drum supported on said roll stands;

a pressure roller assembly including a pressure roller via which the web is routed to pass onto said reel-up drum and which can be actuated from an open position towards said roll stands to a closed position so as to press said pressure roller against said reel-up drum providing a nip for the web therebetween;

a splicing head assembly for facilitating a continuously running reel-up drum change from said reel-up drum to an additional reel-up drum;

a pressing bar movable between an upper position and a lower position with a path of movement located in the space between said pressure roller and said reel-up drum and via which the path of the web is routed to pass;

whereby when said pressing bar is in its lower position and said pressure roller assembly is in its open position, said pressing bar holds the web at a lower position than that of the nip;

a rail-carriage combination for transporting a nearly completed roll on said reel-up drum from said roll stands to an exit position; and movable secondary drive means adapted to be switched for said primary drive means for driving said reel-drum during movement of the nearly completed roll on said reel-up drum to the exit position during a web splicing and severing operation.

2. The rewinder system according to claim 1, wherein said pressure roller is a bar-shaped pressing shaft pivotably mounted on said pressure roller assembly.

3. The rewinder system according to claim 1, wherein said rail-carriage combination comprises:

rolling rails, gently slanting downwardly from said roll stands toward the exit position, along which the reel-up drum to be transferred can be easily rolled; and transfer carriages adapted for movement in the direction of said rolling rails so as to guide the movement of said reel-up drum during transfer to the exit position.

4. The rewinder system according to claim 9, wherein said secondary drive means is mounted on at least one transfer carriage so as to be moved with it.

5. The rewinder system according to claim 4, wherein said secondary drive means includes a hydraulic motor.

6. The rewinder system according to claim 5, wherein said reel-up drum comprises a reel-up drum shaft having a ring disposed on at least one end thereof, and said hydraulic motor is provided with a small gear wheel for engaging with the inner surface of said ring forming a reduction gear drive.

7. The rewinder system according to claim 1, wherein said splicing hand assembly is positioned before said pressure roller assembly in the feed direction of the web and is adapted to make both a longitudinal and a transverse cut on the web to facilitate the continuously running reel-up drum change.

* * * * *